US012566012B2

(12) United States Patent
D'Souza

(10) Patent No.: US 12,566,012 B2
(45) Date of Patent: Mar. 3, 2026

(54) SYSTEM AND METHOD TO AVOID MIXED AIR CONDENSATION

(71) Applicant: Haier US Appliance Solutions, Inc., Wilmington, DE (US)

(72) Inventor: Bryan Isaac D'Souza, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 78 days.

(21) Appl. No.: 18/415,277

(22) Filed: Jan. 17, 2024

(65) Prior Publication Data

US 2025/0230949 A1 Jul. 17, 2025

(51) Int. Cl.

| | |
|---|---|
| ***F24F 13/22*** | (2006.01) |
| ***F24F 1/027*** | (2019.01) |
| ***F24F 1/0284*** | (2019.01) |
| ***F24F 11/84*** | (2018.01) |
| ***F24F 11/86*** | (2018.01) |
| *F24F 110/10* | (2018.01) |
| *F24F 110/12* | (2018.01) |
| *F24F 110/20* | (2018.01) |
| *F24F 110/22* | (2018.01) |

(52) U.S. Cl.

CPC ..... *F24F 13/22* (2013.01); *F24F 1/027* (2013.01); *F24F 1/0284* (2019.02); *F24F 11/84* (2018.01); *F24F 11/86* (2018.01); *F24F 2013/221* (2013.01); *F24F 2110/10* (2018.01); *F24F 2110/12* (2018.01); *F24F 2110/20* (2018.01); *F24F 2110/22* (2018.01)

(58) Field of Classification Search

CPC ..... F24F 2110/10; F24F 11/76; F24F 11/77; F24F 11/86; F24F 2110/12; F24F 2110/20

See application file for complete search history.

(56) References Cited

U.S. PATENT DOCUMENTS

| | | | | |
|---|---|---|---|---|
| 3,938,348 | A * | 2/1976 | Rickert | F24F 1/027 62/262 |
| 2018/0328619 | A1* | 11/2018 | Beilfuss | F24F 11/58 |
| 2019/0293305 | A1* | 9/2019 | Henderson | F24F 11/30 |
| 2021/0404671 | A1* | 12/2021 | Shaffer | F24F 1/0373 |
| 2022/0333811 | A1* | 10/2022 | Bailey | F24F 11/64 |
| 2023/0073117 | A1* | 3/2023 | Longenecker | F24D 15/04 |

FOREIGN PATENT DOCUMENTS

| | | |
|---|---|---|
| CN | 110425670 B | 6/2021 |
| CN | 111928432 B | 12/2021 |
| WO | WO2023045321 A1 | 3/2023 |

* cited by examiner

*Primary Examiner* — Lionel Nouketcha

(74) *Attorney, Agent, or Firm* — Dority & Manning, P.A.

(57) ABSTRACT

An air conditioning unit configured to introduce outdoor makeup air to a conditioned space includes sensors to determine the characteristics of the indoor air and the outdoor makeup air. Input from the sensors is used to determine characteristics of a mixed flow of indoor air and outdoor makeup air prior to discharge of the mixed flow to the conditioned space. The air conditioning unit modifies one or more of the indoor fan speed, outdoor fan speed, compressor speed, and electronically controlled expansion device to adjust the characteristics of the mixed flow to avoid condensation.

20 Claims, 10 Drawing Sheets

SYSTEM AND METHOD TO AVOID MIXED AIR CONDENSATION

FIELD OF THE INVENTION

The present disclosure relates generally to air conditioner units, in particular air conditioner units having a fresh air make-up capability.

BACKGROUND OF THE INVENTION

Air conditioners or air conditioner units are conventionally utilized to adjust the temperature in an indoor space, e.g., within structures such as dwellings and office buildings. Such units commonly include a closed refrigeration loop to heat or cool the indoor air. Typically, the air conditioner unit cycles to an "on" condition when the indoor air temperature is outside of a prescribed range and cycles to an "off" cycle when the temperature in the conditioned space reaches a prescribed temperature. Generally, the indoor air is recirculated while being conditioned during an "on" cycle. A variety of sizes and configurations are available for such air conditioner units. For example, some units may have one portion installed within the indoor space that is connected to another portion located outdoors, e.g., by tubing or conduit carrying refrigerant.

Another type of air conditioner unit, commonly referred to as packaged terminal air conditioners (PTAC), may be utilized to adjust the temperature in, for example, a single room or group of rooms, or conditioned spaces, of a structure. These units typically operate like split heat pump systems, with the indoor and outdoor portions defined by a bulkhead and all system components are housed within a single package that is installed in a wall sleeve positioned within an opening of an exterior wall of a building.

In some applications, PTACs may be required to continuously draw outdoor make-up air through the outdoor portion and into the indoor portion to provide fresh air ventilation to the indoor space. Accordingly, some PTACs allow for the introduction of outdoor make-up air into the indoor space, e.g., through a vent aperture defined in the bulkhead that separates the indoor and outdoor sides of the unit. The make-up air may be provided during off cycles of the air conditioner unit. Generally, such PTACs combine the outside make-up air with the recirculating conditioned indoor air and provide the combined air to the conditioned space.

Under some conditions, the combined flow of unconditioned outside air and conditioned indoor air equals or exceeds a prescribed humidity, for example 100% relative humidity. In such conditions, the excess water in the combined stream condenses out of the air stream and collects in unintended area of the air conditioner. The unanticipated water can lead to mechanical failure of components, rusting of air conditioner parts, and may support bacterial growth. Accordingly, improvements in controlling the relative humidity of a mixed air stream may be desirable.

BRIEF DESCRIPTION OF THE INVENTION

Aspects and advantages of the invention will be set forth in part in the following description, may be apparent from the description, or may be learned through practice of the invention.

In one exemplary aspect, an air conditioner unit comprises a refrigeration loop comprising an indoor heat exchanger and an outdoor heat exchanger, a compressor operably coupled to the refrigeration loop and being configured to urge refrigerant through the refrigeration loop, an expansion device fluidly coupled to the refrigeration loop, an indoor fan operable to urge an indoor air flow through the indoor heat exchanger, an auxiliary fan operable to urge an outdoor make-up air flow to combine with the indoor air flow to produce a mixed air flow, and a controller operably coupled to the compressor, the expansion device, the indoor fan, and the auxiliary fan. The controller is configured to operate the refrigeration loop at default parameters, operate the indoor fan at a first indoor fan speed, determine characteristics of the indoor air flow, operate the auxiliary fan at a first auxiliary fan speed, determine characteristics of an outdoor make-up air flow, determine characteristics of the mixed air flow, determine that the characteristics of the mixed air flow are greater than a predetermined limit, and implement a responsive action in response to determining that the characteristics of the mixed air flow exceed the predetermined limit.

In another exemplary aspect, a method of operating an air conditioner unit comprising a refrigeration loop comprising an indoor heat exchanger, an outdoor heat exchanger, a compressor configured to urge refrigerant through the refrigeration loop, an expansion device, an indoor fan operable to urge an indoor air flow over the indoor heat exchanger, and an auxiliary fan operable to urge a flow of outdoor air to combine with the flow of indoor air to produce a mixed air flow is presented. The method comprises operating the refrigeration loop at default parameters, operating the indoor fan at a first indoor fan speed, determining characteristics of the indoor air flow, operating the auxiliary fan at a first auxiliary fan speed, determining characteristics of an outdoor make-up air flow, determining characteristics of the mixed air flow, determining that the characteristics of the mixed air flow are greater than a predetermined limit and implementing a responsive action in response to determining that the characteristics of the mixed air flow exceed the predetermined limit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
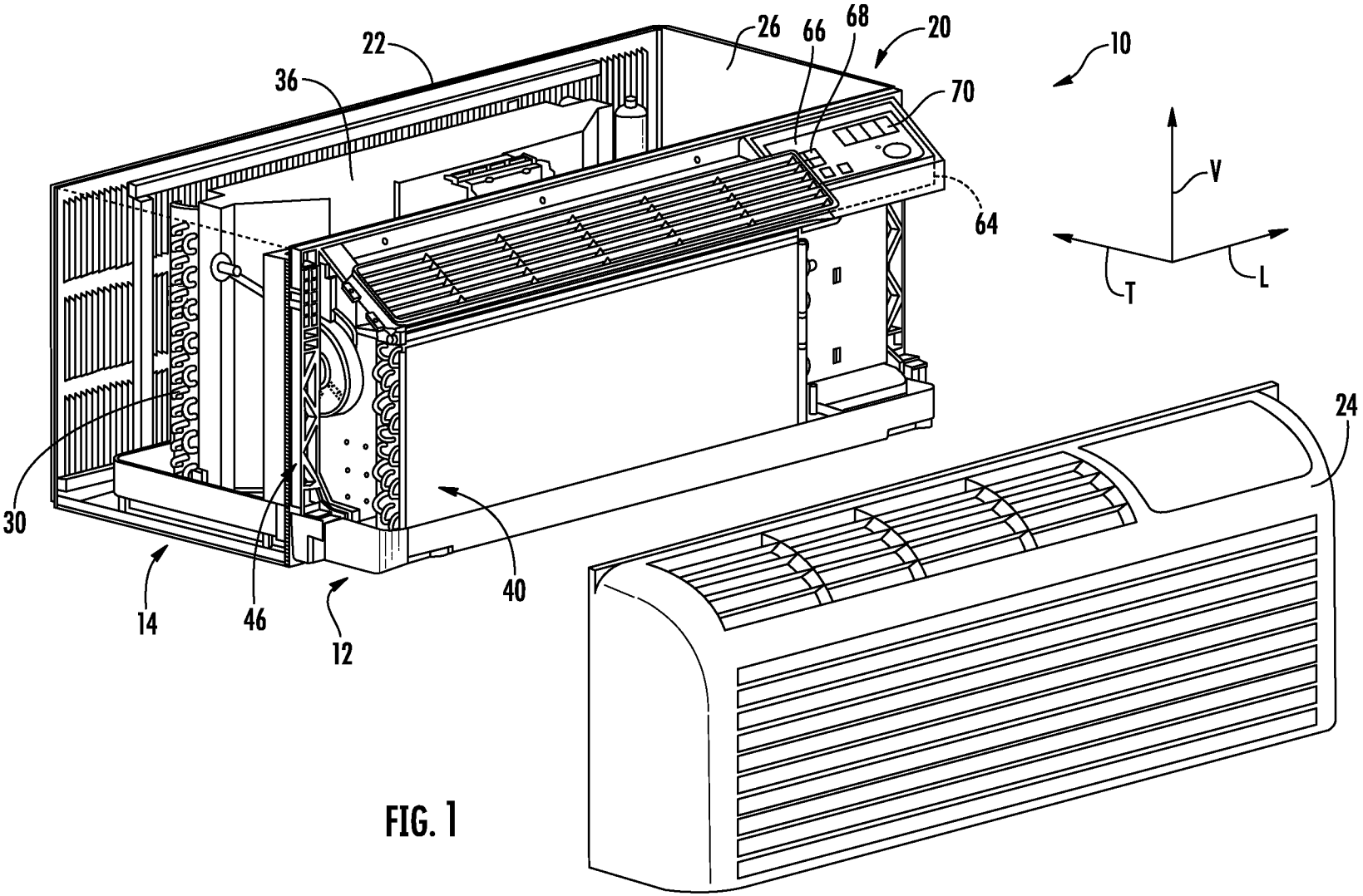
FIG. 1 provides a perspective view of an air conditioner unit in partial exploded view in accordance with an exemplary embodiment of the present disclosure.

Repeated use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
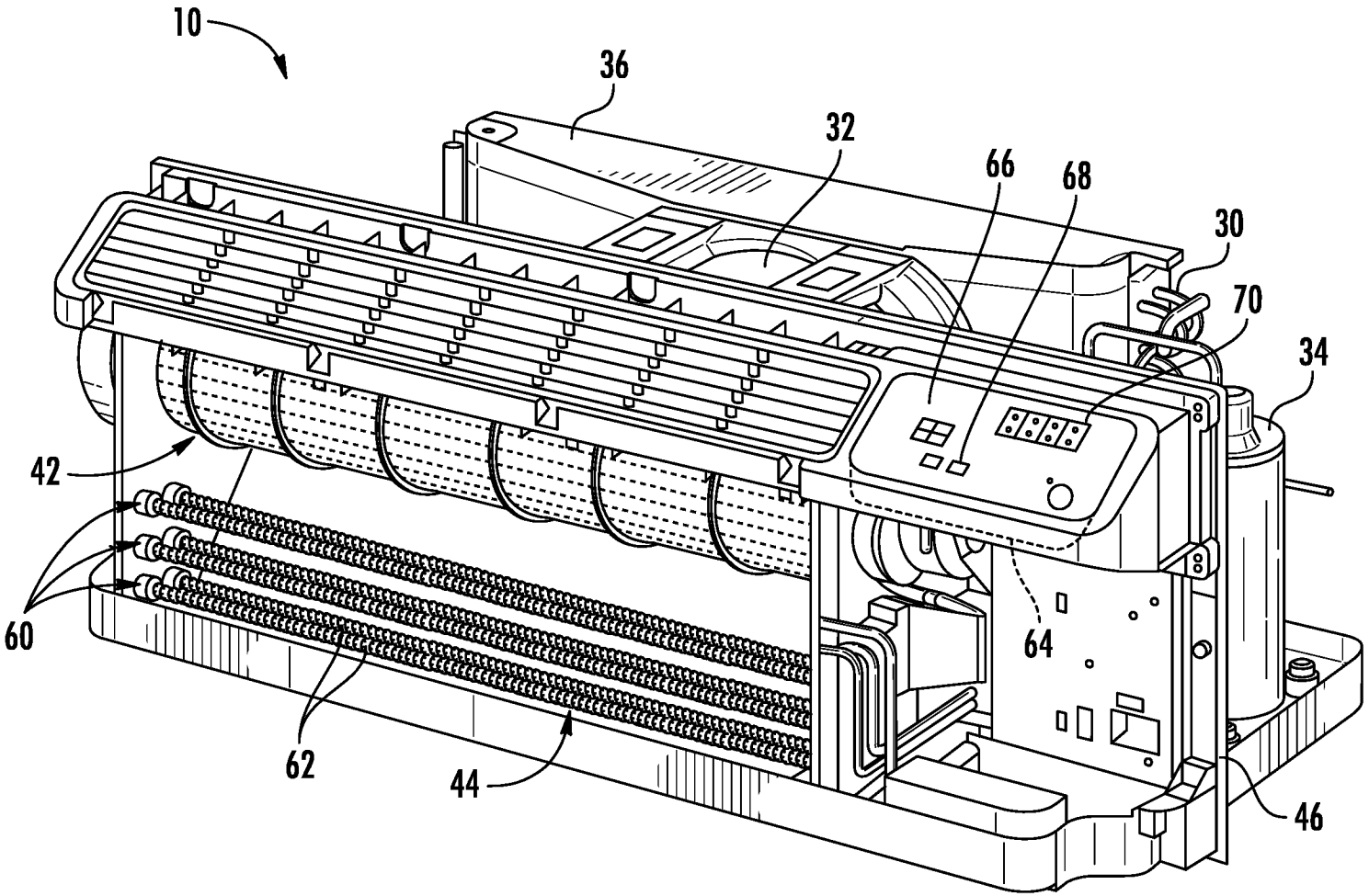
FIG. 2 is another front perspective view of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined. Although aspects of the present subject matter are described with reference to PTAC unit 10, it should be appreciated that aspects of the present disclosure may be equally applicable to other air conditioner unit types and configurations, such as single package vertical units (SPVUs) and split heat pump systems.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown to direct the flow of outside air over or through the outdoor heat exchanger 30.

Indoor portion 12 may include, for example, an indoor heat exchanger 40, a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14. According to some embodiments, indoor fan 42 is a variable speed fan, for example, a variable centrifugal blower or fan as illustrated, for example in FIG. 7.

Figure 3:
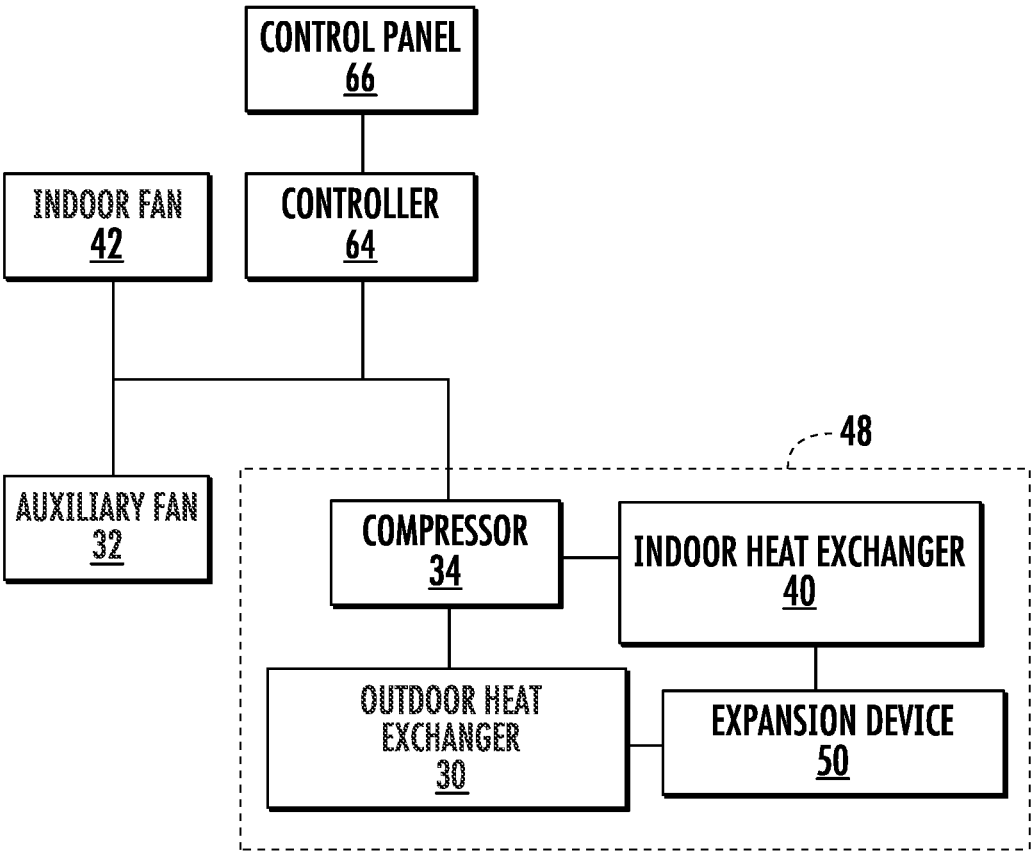
FIG. 3 is a schematic representation of a refrigeration loop in accordance with an embodiment of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. The compressor 34 is configured to urge refrigerant to flow through the refrigeration loop 48 in a refrigeration cycle. More particularly, refrigeration loop 48 may include various lines for flowing refrigerant between the various components of refrigeration loop 48, thus providing the fluid communication therebetween. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such examples and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode and thus performing a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an exemplary embodiment, compressor 34 may be a variable speed compressor. In this regard, compressor 34 may be operated at various speeds depending on the current air conditioning needs of the conditioned space and the demand from refrigeration loop 48 as determined by controller 64. For example, according to an exemplary embodiment, compressor 34 may be configured to operate at any speed between a minimum speed, e.g., about 1500 revolutions per minute (RPM), to a maximum rated speed, e.g., about 6000 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the conditioned space. According to some embodiments, the compressor speed may be decreased, or ramped down, from a first speed to a second, lower speed at a predetermined compressor ramp-down rate of, for example, about 100 RPM/minute. The second speed may be a minimum compressor speed, e.g., about 1500 RPM.

Specifically, according to an exemplary embodiment, compressor 34 may be an inverter compressor. In this regard, compressor 34 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 34 may be regulated to any suitable operating speed, e.g., from 0% to 100% of the full rated power and/or speed of the compressor. This may facilitate precise compressor operation at the desired operating power and speed, thus meeting system needs while maximizing efficiency and minimizing unnecessary system cycling, energy usage, and noise.

Figure 4:
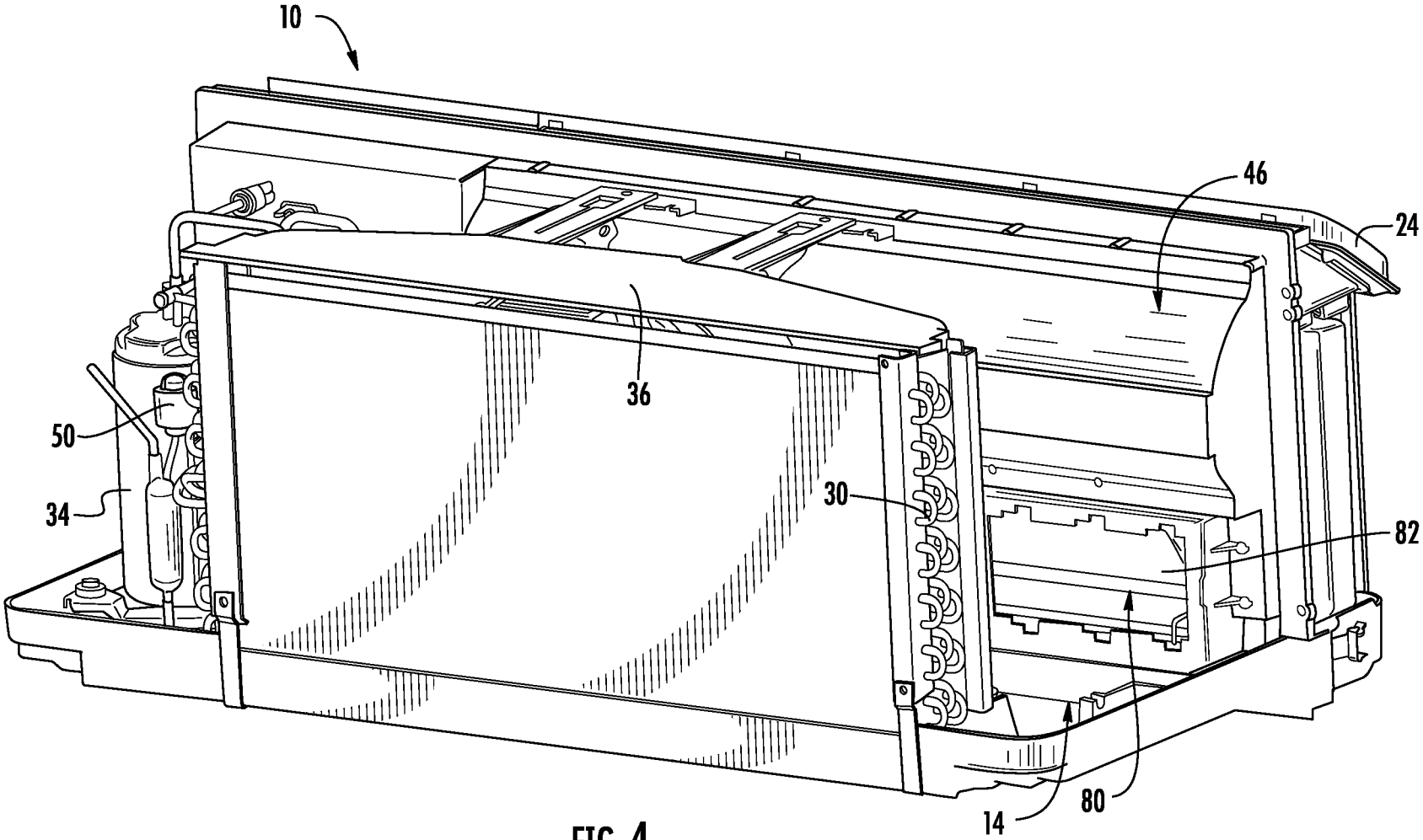
FIG. 4 is a rear perspective view of an outdoor portion of the exemplary air conditioner unit of FIG. 1 in accordance with an embodiment of the present disclosure.

In exemplary embodiments as illustrated in FIG. 4, expansion device 50 may be disposed in the outdoor portion 14 between the indoor heat exchanger 40 and the outdoor heat exchanger 30. According to the exemplary embodiment, expansion device 50 may be an electronic expansion valve ("EEV") that enables controlled expansion of refrigerant, as is known in the art. According to alternative embodiments, expansion device 50 may be a capillary tube or another suitable expansion device configured for use in a thermodynamic cycle.

More specifically, according to exemplary embodiments, the electronic expansion device EEV 50 may be configured to precisely control the expansion of refrigerant to maintain, for example, a desired temperature differential of the refrigerant across the evaporator (i.e., the outdoor heat exchanger 30 in heat pump mode). For example, a default superheat setting may result in a default superheat of 2 degrees Fahrenheit (2° F.). In other words, electronic expansion device 50 throttles the flow of refrigerant based on the reaction of the temperature differential across the evaporator or the amount of superheat temperature differential (i.e., a default superheat of 2° F. in this example), thereby ensuring that the refrigerant is in the gaseous state entering compressor 34.

In general, the terms "superheat," "operating superheat," or the like are generally intended to refer to the temperature increase of the refrigerant in excess of the fully saturated vapor temperature in the evaporator. In this regard, for example, the superheat may be quantified in degrees Fahrenheit, e.g., such that 1° F. superheat means that the refrigerant exiting the evaporator is 1° F. higher than the saturated vapor temperature. It should be appreciated that the operating superheat may be measured and monitored by controller 64 in any suitable manner. For example, controller 64 may be operably coupled to a pressure sensor for measuring the refrigerant pressure exiting the evaporator, may convert that pressure to the saturated vapor temperature, and may subtract that temperature from the measured refrigerant temperature at the evaporator outlet to determine superheat.

According to exemplary embodiments, EEV 50 is in operative communication with the controller 64. The controller 64 configures or adjusts the EEV 50 to provide an orifice opening to produce a desired superheat. For example, the EEV may be driven by a stepper motor or other drive mechanism to any desired opening position for the orifice between a fully closed position (e.g., when no refrigerant passes through EEV 50) to a fully open position (e.g., when there is little or no restriction through the EEV 50). For example, controller 64 may be operably coupled to EEV 50 and may regulate the position of the EEV 50 through a control signal to achieve a target superheat, a target restriction/expansion, etc.

More specifically, the control signal communicated from controller 64 may specify the number of control steps (or simply "steps") and a corresponding direction (e.g., counterclockwise toward the closed position or clockwise toward the open position). Each EEV 50 may have a physical stroke span equal to the difference between the fully open position and the fully closed position. In addition, the EEV 50 may include a step range or range of control steps that correspond to the number of adjustment steps it takes for the EEV 50 to travel from the fully closed position to the fully open position.

Each "step" may refer to a predetermined rotation of the drive mechanism, e.g., such as a stepper motor, which may in turn move the EEV 50 a fixed linear distance toward the open or closed position (depending on the commanded step direction). For example, according to the exemplary embodiment, the EEV 50 may have a step range of 500 steps, with 0 steps corresponding to fully closed and 500 steps corresponding to fully open. However, it should be appreciated that according to alternative embodiments, any given electronic expansion valve may include a different number of control steps, and the absolute step adjustments described herein may be varied accordingly.

In addition, as used herein, the position of EEV 50 may be expressed as a percentage, e.g., where 0% corresponds to a fully closed position and 100% corresponds to a fully open position. According to exemplary embodiments, this percentage representation may also refer to the percentage of total control steps taken from the closed position, e.g., with 10% referring to 50 steps (e.g., 10% of the 500 total steps) and 80% referring to 400 steps (e.g., 80% of 500 total steps).

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44 to "pull" air over or through the indoor heat exchanger 40. Alternatively, indoor fan 42 may be positioned upstream of indoor heat exchanger 40 along the flow direction of indoor air and may operate to "push" air over or through indoor heat exchanger 40.

Heating unit 44 in exemplary embodiments includes one or more heater banks 60. Each heater bank 60 may be operated as desired to produce heat under the control of controller 64. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally), indoor fan 42, outdoor fan 32, heating unit 44, expansion device 50, auxiliary fan 102, and other components of refrigeration loop 48 may be controlled by a processing device such as a controller 64 (e.g., FIG. 1). In some embodiments, control panel 66 may include or be in operative communication with one or more user input devices 68, such as one or more of a variety of digital, analog, electrical, mechanical, or electromechanical input devices including rotary dials, control knobs, push buttons, toggle switches, selector switches, and touch pads. Additionally, air conditioner unit 10 may include a display 70, such as a digital or analog display device generally configured to provide visual feedback regarding the operation of unit 10. For example, display 70 may be provided on control panel 66 and may include one or more status lights, screens, or visible indicators. According to exemplary embodiments, user input devices 68 and display 70 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Air conditioner unit 10 may further include or be in operative communication with a processing device or a controller 64 that may be generally configured to facilitate appliance operation. In this regard, control panel 66, user inputs 68, and display 70 may be in communication with controller 64 such that controller 64 may receive control inputs from user inputs 68, may display information using display 70, and may otherwise regulate operation of unit 10. In addition, controller 64 may receive signals sent or communicated by various sensors (e.g., indoor air temperature sensor 120 or indoor air humidity sensor 122) for storage in a memory location or processing in a processor. The processor 64 may communicate a response or instruction to the various systems within unit 10. For example, signals generated or communicated by controller 64 may operate unit 10, including any or all system components, subsystems, or interconnected devices, in response to the position of user input devices 68 and other control commands. Control panel 66 and other components of unit 10 may be in communication with controller 64 via, for example, one or more signal lines or shared communication busses. In this manner, Input/Output ("I/O") signals may be routed between controller 64 and various operational components of unit 10.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 64 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 64 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 64 may be operable to execute programming instructions or micro-control code associated with an operating cycle of unit 10. In this regard, the instructions may be software or any set of instructions that when executed by the processing device, cause the processing device to perform operations, such as running one or more software applications, displaying a user interface, receiving user input, processing user input, etc. Moreover, it should be noted that controller 64 as disclosed herein is capable of and may be operable to perform any methods, method steps, or portions of methods as disclosed herein. For example, in some embodiments, methods disclosed herein may be embodied in programming instructions stored in the memory and executed by controller 64.

The memory devices included or coupled to controller 64 may also store data that can be retrieved, manipulated, created, or stored by the one or more processors or portions of controller 64. The data can include, for instance, data to facilitate performance of methods described herein. The data can be stored locally (e.g., on controller 64) in one or more databases and/or may be split up so that the data is stored in multiple locations. In addition, or alternatively, the one or more database(s) can be connected to controller 64 through any suitable network(s), such as through a high bandwidth local area network (LAN) or wide area network (WAN). In this regard, for example, controller 64 may further include a communication module or interface that may be used to communicate with one or more other component(s) of unit 10, controller 64, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 5:
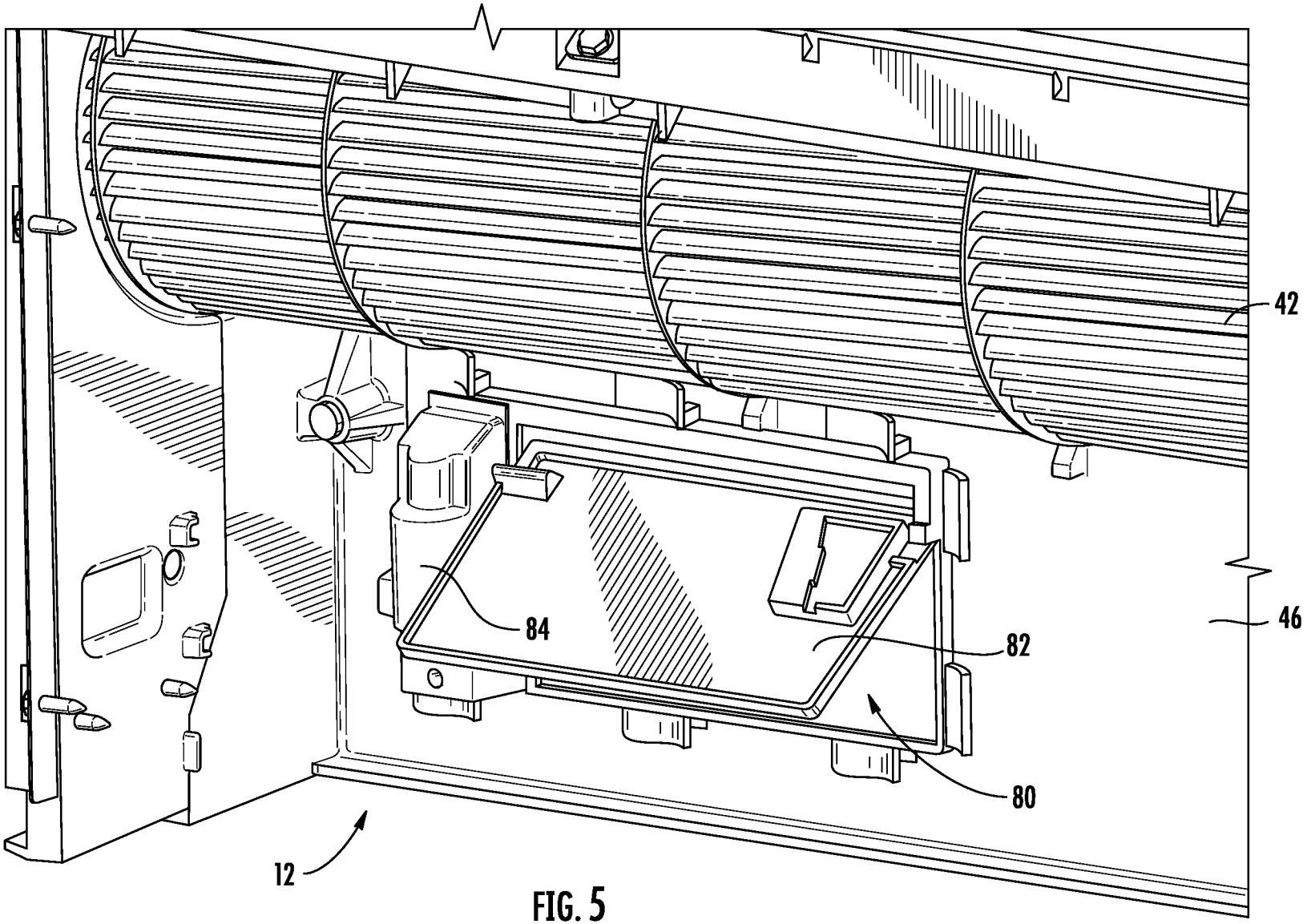
FIG. 5 is an enlarged front perspective view of a portion of the air conditioner unit of FIG. 4 in accordance with an embodiment of the present disclosure.

Referring to FIGS. 4 and 5, a vent aperture 80 may be defined in bulkhead 46 for providing fluid communication between indoor portion 12 and outdoor portion 14. In particular, vent aperture 80 fluidly couples the outside portion 14 with plenum 16 and indoor fan 42 which is in fluid communication with both the plenum 16 and the conditioned space. Vent aperture 80 may be utilized in an installed air conditioner unit 10 to allow outdoor air to mix with indoor air (i.e., recirculating indoor air) in the plenum 16 adjacent to indoor fan 42, forming a mixed airflow 118 for discharge into the conditioned space through the discharge vent 112. In this regard, in some cases it may be desirable to allow fresh outside air (i.e., "make-up air" 116) to flow into the conditioned space in order, e.g., to meet government regulations, to compensate for negative pressure created within the conditioned space, etc. In this manner, according to an exemplary embodiment, make-up air may be provided into the space through fan assembly 100 (described below), vent aperture 80, plenum 16, and discharge vent 112 as required or when desired, with a temperature and a humidity level similar, or substantially similar, to the conditioned space target or predetermined conditions.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of bulkhead 46 and pivotable towards indoor portion 12. Vent door 82 may open to a plenum 16 formed at the indoor facing side of bulkhead 46. The auxiliary fan 102 urges a flow of outdoor make-up air 116 into the plenum 16 to combine with the recirculating flow of indoor air 114 to produce a mixed airflow 118 that is directed through the discharge vent 112 and into the conditioned space. The recirculating flow of indoor air 114 and the mixed airflow 118 are motivated to flow by the action of indoor fan 42.

Vent door 82 may be configured to pivot between a first, closed position (FIG. 4) where vent door 82 prevents air from flowing between outdoor portion 14 and plenum 16, and a second, open position where vent door 82 is in an open position (as shown in FIG. 5) and allows make-up air to flow into the plenum 16. According to the illustrated embodiment (FIG. 5), vent door 82 may be pivoted between the open and closed position by an electric motor 84 controlled by controller 64, or by any other suitable method. Other configurations of the vent aperture 80 and vent door 82 may be used to selectively control the flow of make-up air 116 into the plenum 16.

Figure 6:
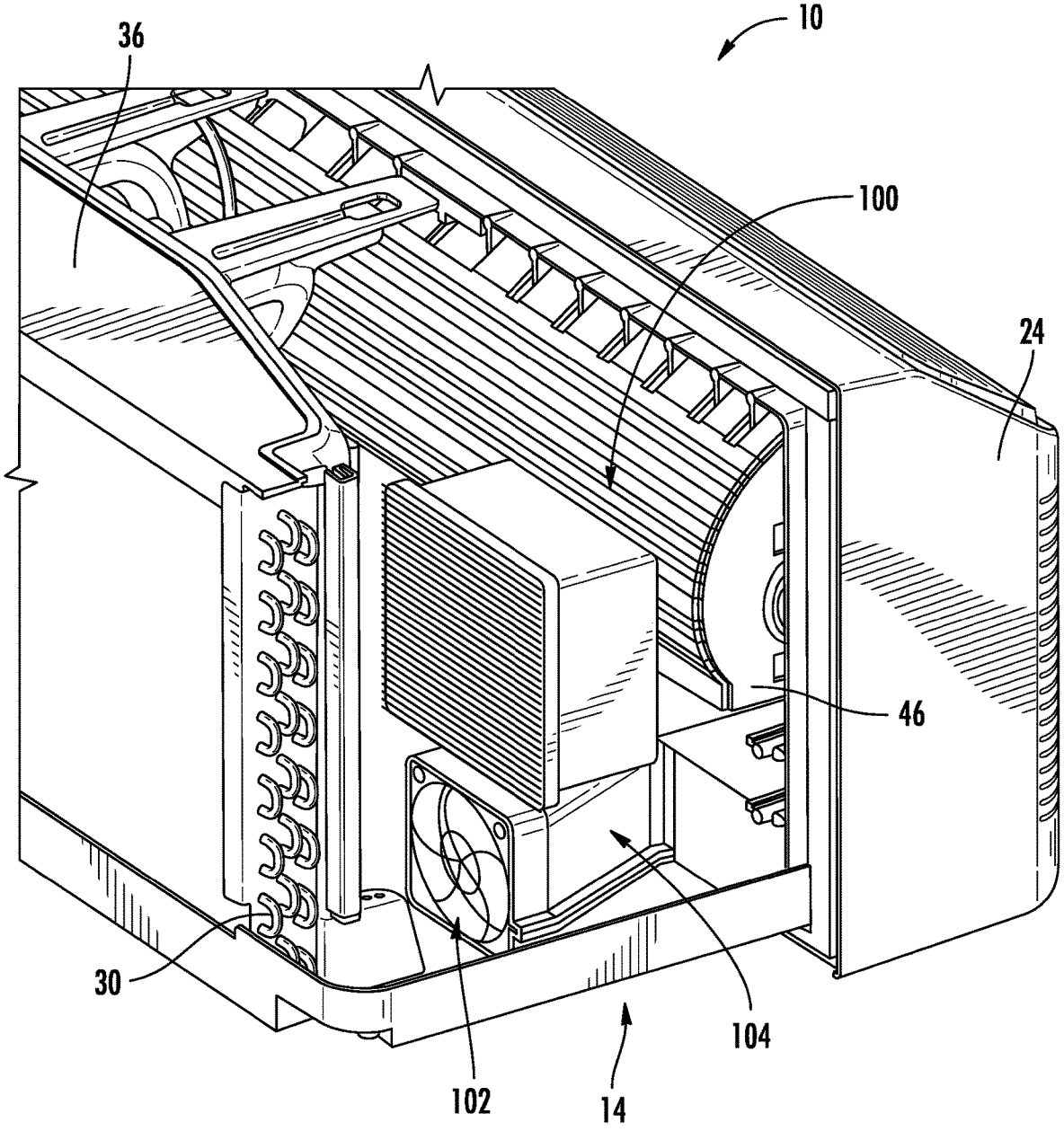
FIG. 6 is a rear perspective view of the exemplary air conditioner unit and bulkhead of FIG. 4 including a fan assembly for providing make-up air in accordance with an embodiment of the present disclosure.

Referring now to FIG. 6, an auxiliary fan assembly, fan assembly 100, will be described according to an exemplary embodiment of the present subject matter. According to the illustrated embodiment, fan assembly 100 is generally configured for urging the flow of make-up air 116 through vent aperture 80 and into the plenum 16 for combination with the flow of indoor air 114 for discharge into a conditioned space without the assistance of an auxiliary sealed system. However, it should be appreciated that fan assembly 100 could be used in conjunction with a make-up air module including an auxiliary sealed system for conditioning the flow of make-up air. As illustrated in FIG. 6, fan assembly 100 includes one auxiliary fan 102 for urging a flow of make-up air through a fan duct 104, through vent aperture 80, to indoor fan 42. In other embodiments, more than one auxiliary fan 102 may be used.

According to the illustrated embodiment of FIG. 6, auxiliary fan 102 is an axial fan positioned at an inlet of fan duct 104, e.g., upstream from vent aperture 80. In embodiments, the auxiliary fan 102 may be a variable speed fan, with the fan speed controlled by the controller 64. However, it should be appreciated that any other suitable number, type, and configuration of fan or blower could be used to urge a flow of make-up air according to alternative embodiments. In addition, auxiliary fan 102 may be positioned in any other suitable location within air conditioner unit 10, and auxiliary fan 102 may be positioned at any other suitable location within or in fluid communication with fan duct 104. The embodiments described herein are exemplary and are not intended to limit the scope present subject matter.

Figure 7:
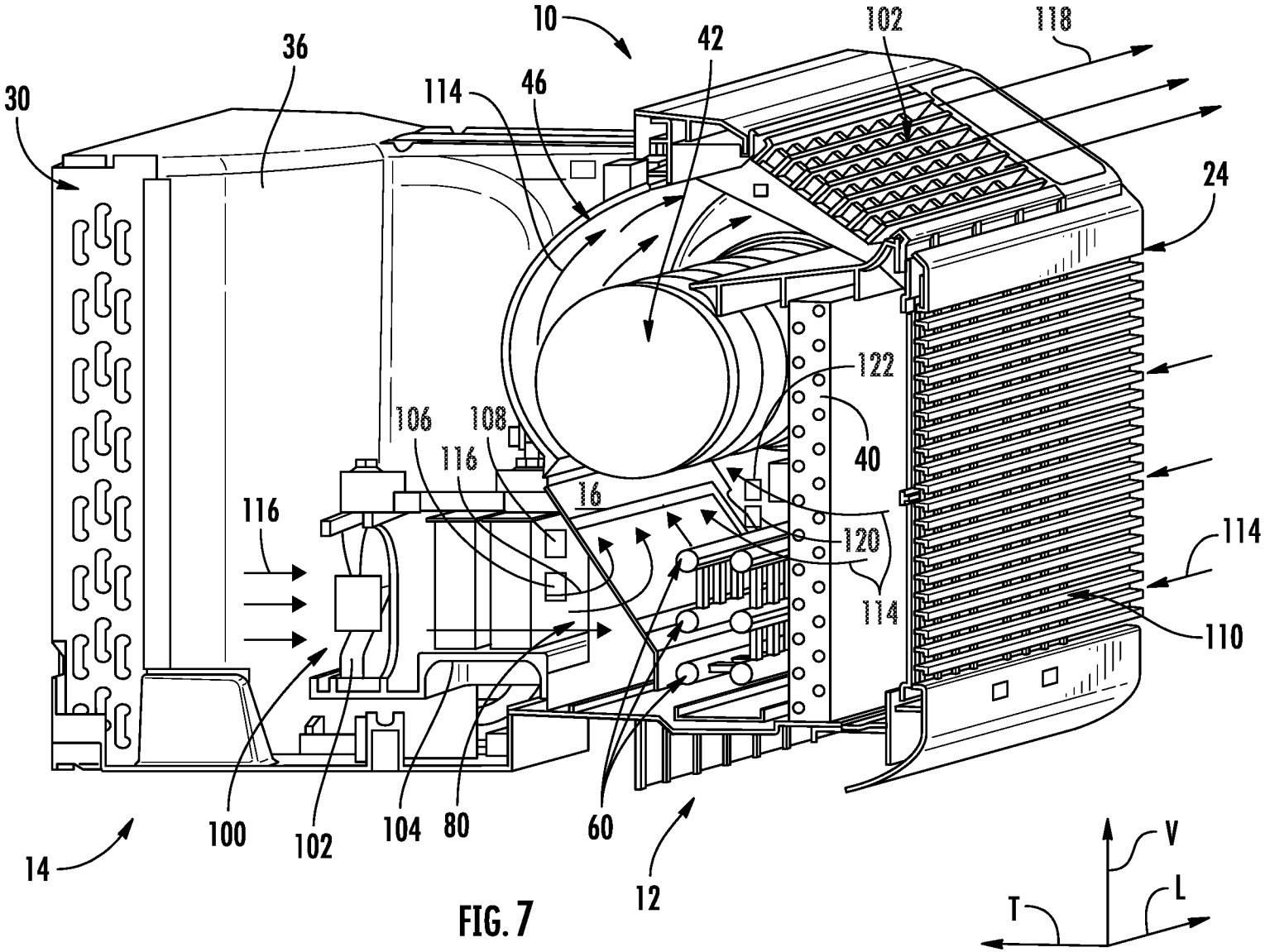
FIG. 7 is a side cross sectional view of the exemplary air conditioner unit of FIG. 1.

Referring now to FIG. 7, operation of unit 10 will be described according to an exemplary embodiment. More specifically, the operation of components within indoor portion 12 will be described during a cooling operation or cooling and dehumidifying cycle of unit 10. Although a cooling and dehumidifying cycle will be described, it should be further appreciated that indoor heat exchanger 40 and/or heating unit 44 may be used to heat indoor air according to alternative embodiments. Moreover, although operation of unit 10 is described below for the exemplary packaged terminal air conditioner (PTAC) unit, it should be further appreciated that aspects of the present subject matter may be used in any other suitable air conditioner unit, such as a heat pump or split unit system.

As illustrated, room front 24 of unit 10 generally defines an intake vent 110 and a discharge vent 112 for use in circulating a flow of indoor air (indicated by arrows 114) throughout a conditioned space. In this regard, indoor fan 42 is generally configured for drawing in indoor air 114 through intake vent 110 and urging the flow of air over or through indoor heat exchanger 40 before discharging the indoor air 114 out of discharge vent 112. According to the illustrated embodiment, intake vent 110 is positioned proximate to a bottom of unit 10 and discharge vent 112 is positioned proximate to a top of unit 10. However, it should be appreciated that according to alternative embodiments, intake vent 110 and discharge vent 112 may have any other suitable size, shape, position, or configuration.

During a cooling cycle, refrigeration loop 48 is generally configured for urging cold refrigerant through indoor heat exchanger 40 in order to lower the temperature of the flow of indoor air 114 before discharging it back into the conditioned space. In embodiments, the flow of indoor air 114 passes over or through the indoor heat exchanger 40 prior to being combined with outdoor make-up air 116 to form a mixed airflow 118 that is discharged into the conditioned space. Specifically, during a cooling operation, controller 64 may be provided with a cooling target temperature, e.g., as set by a user for the desired room temperature. In general, components of refrigeration loop 48, outdoor fan 32, indoor fan 42, auxiliary fan 102, and other components of unit 10 operate to continuously cool the flow of indoor air, and mix the outdoor make-up air with the cooled flow of indoor air (i.e., conditioned air), until the target temperature is reached and the cooling cycle ceases. If the room temperature reaches an upper limit temperature, for example a predetermined offset from the cooling target temperature, the cooling cycle may begin again. In embodiments providing a flow of make-up air 116 to the conditioned space, for example using auxiliary fan 102, the auxiliary fan 102 may continuously operate independently of the cooling cycle.

In order to facilitate operation of refrigeration loop 48 and other components of unit 10 in a method in accordance with this disclosure, unit 10 may include a variety of sensors for detecting conditions of the discharged or flow of mixed air 118 supplied to a conditioned space by the unit 10. These conditions can be fed to controller 64 which may make decisions regarding operation of unit 10 to rectify undesirable conditions or to otherwise condition the flow of mixed air 118 into the conditioned space. For example, as best illustrated in FIG. 7, unit 10 may include an indoor temperature sensor 120 which is positioned downstream (i.e., in the direction of the indoor air flow) from the indoor heat exchanger 40 to detect the temperature of the indoor air 114 after conditioning at the indoor heat exchanger 40. In addition, unit 10 may include a humidity sensor 122 which is also positioned in the indoor air flow 114 downstream from the indoor heat exchanger 40 and configured for detecting the humidity of the indoor air 114 after conditioning and prior to mixing with the outdoor make-up air 116 (i.e., upstream from the plenum 16). The temperature and humidity sensors 120, 122 may be operatively connected to the controller 64 to communicate a temperature signal and a humidity signal proportional to the sensed temperature and humidity.

In addition, sensors may be provided to sense the temperature and humidity of the outdoor make-up air. As illustrated in FIG. 7, make-up temperature sensor 106 and make-up humidity sensor 108 may be provided in the flow of make-up air 116 prior to mixing with indoor air 114. Make-up air sensors 106, 108 may be operatively connected to the controller 64 to communicate a temperature signal and a humidity signal proportional to the sensed temperature and humidity of the outdoor make-up air.

Controller 64 may process the signals from indoor and outdoor make-up sensors 120, 122, 106, 108 and operate the components of unit 10 to maintain conditions of a flow of mixed air 118 within a prescribed range. In this manner, unit 10 may be used to regulate the discharge flow of mixed air 118 provided to the conditioned space.

Figure 8:
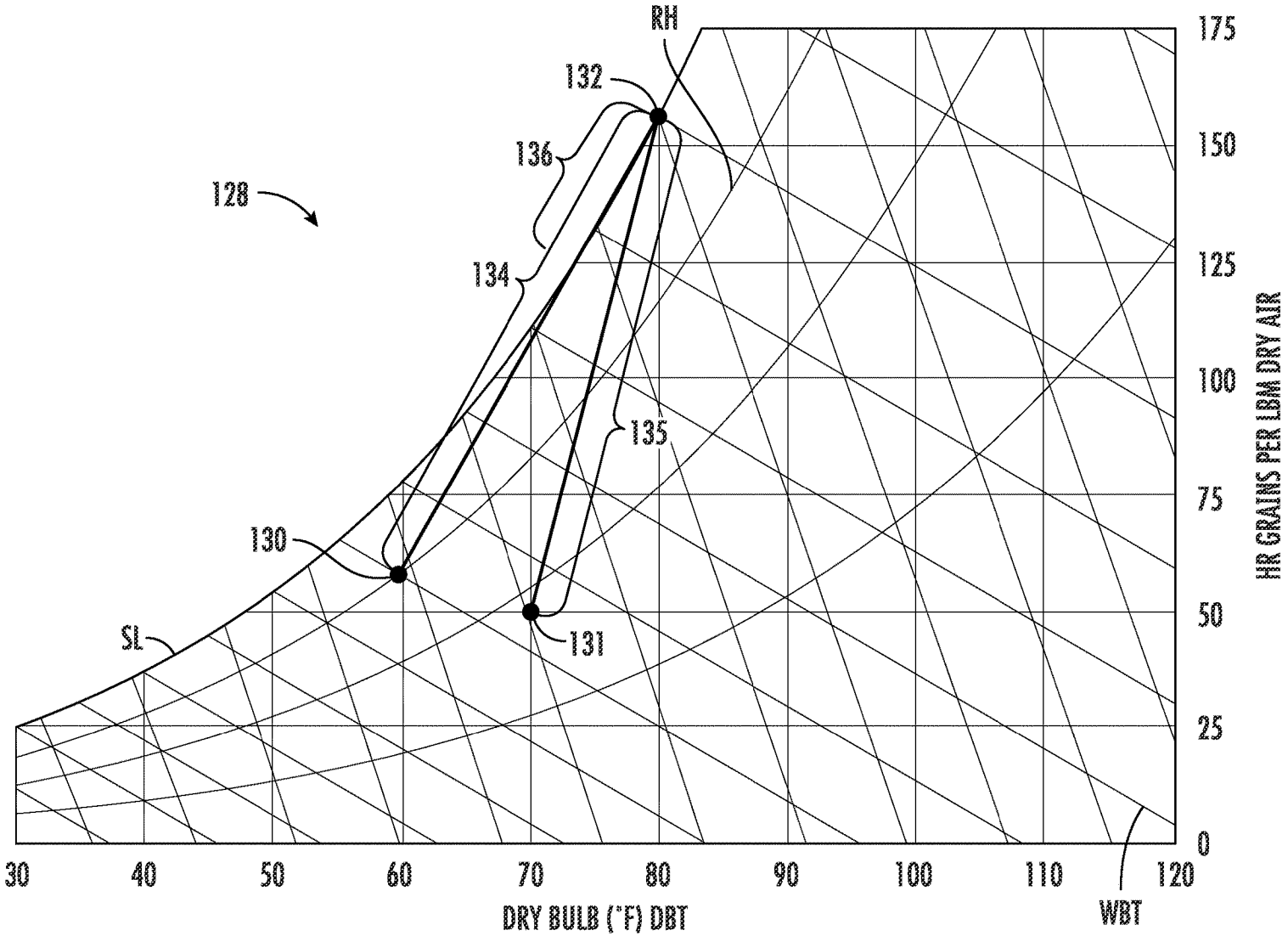
FIG. 8 provides a representative psychrometric chart illustrating characteristics of air flows in accordance with an embodiment of the present invention.
Figure 10:
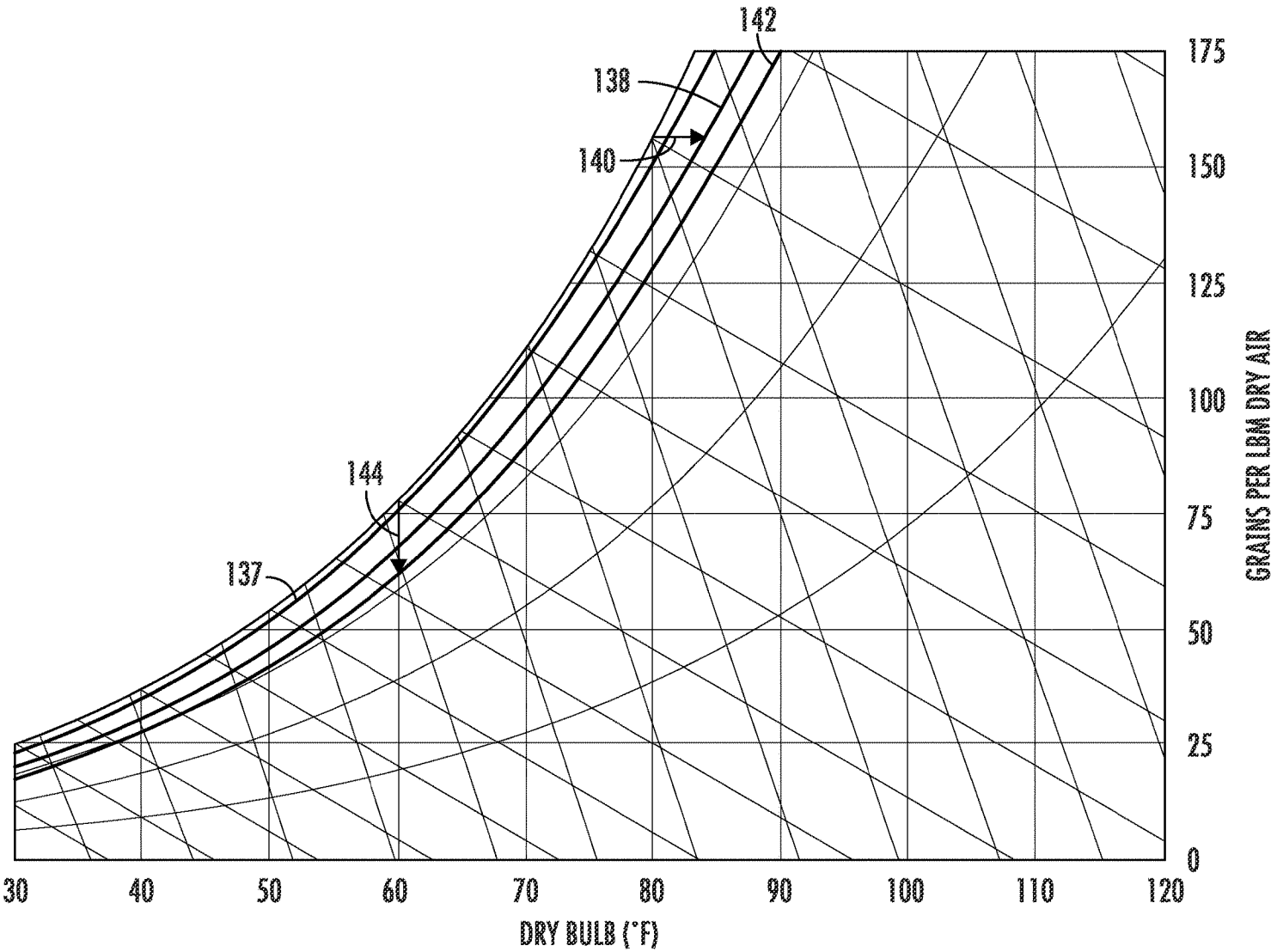
FIG. 10 provides a representative psychrometric chart illustrating exemplary predetermined limits of psychrometric characteristics in accordance with embodiments of the present disclosure.

Now that the construction of air conditioner unit 10 and the configuration of controller 64 according to exemplary embodiments have been presented, an exemplary method 200 of operating an air conditioner unit 10 will be described. Reference will be made to FIGS. 8 and 10, representative psychrometric charts for a constant pressure, which plot dry bulb temperature (DBT), wet bulb temperature (WBT), relative humidity (RH), and humidity ratio (HR). Humidity ratio is generally recognized as the ratio of mass of moisture per mass of dry air in the air flow. As understood and illustrated in FIG. 8, any two characteristics of an air flow determine the other characteristics.

The DBT is plotted along the horizontal (X) axis and the HR is plotted along the vertical (Y) axis. The RH is represented by the curved lines extending upward and to the right. The left-most RH line is the saturation line (SL) representing a condition of 100% RH. Points to the left or above the saturation line represent unstable conditions in which moisture will condense out of the air flow. Points to the right and below the SL may represent a region of desirable psychrometric characteristics for operating a representative air conditioning unit 10. The intersection of a DBT and the saturation curve defines the dew point temperature (DPT) for the associated HR. The WBT lines extend downward and to the right from the DPT, representing a constant WBT corresponding to the value at the intersection with the X-axis.

Figure 9:
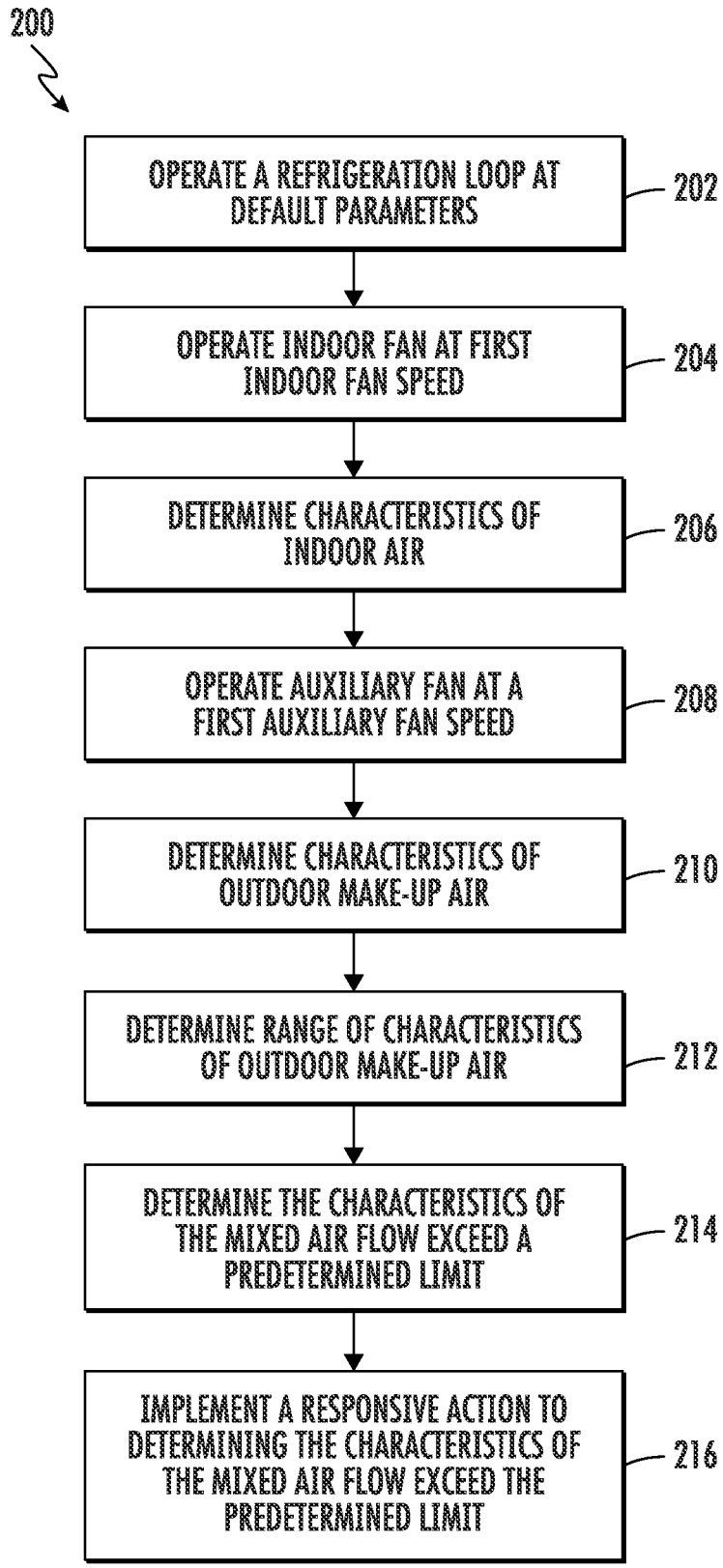
FIG. 9 illustrates a method of operating an air conditioner unit in accordance with an embodiment of the present disclosure.

Referring to FIG. 9, method 200 includes, at step 202, operating the refrigeration loop 48 at default parameters. In this regard, the controller 64 is in operative communication with the compressor 34 and expansion device 50. The controller 64 may operate the compressor 34 at a default speed measured in revolutions per minute (RPM) and, in embodiments in which the expansion device 50 is an EEV, operate the EEV to a default opening position. For example, default parameters may include a compressor speed of 3600 RPM and an EEV at a 30% open setting. The default parameters may be determined or calculated to produce sufficient cooling capacity under a particular set of conditions. In some embodiments, the default parameters may be the previous operation settings for the compressor speed and expansion device. As above, the compressor urges the flow of working fluid, or refrigerant, through the refrigeration loop 48 shown schematically in FIG. 3.

The method further includes, at step 204, operating an indoor fan 42 at a first fan speed. The indoor fan 42 is in operative communication with the controller 64 and may be initially operated at a default speed measured in RPM. The indoor fan 42 may be a variable speed fan operable at more than one speed, the fan speed provided at the instruction of the controller 64. Indoor fan 42 is operable to urge, or draw, a flow of indoor air 114 into intake vent 110 at the lower portion of the room front 24 of air conditioner unit 10. The indoor fan 42 further urges the flow of indoor air 114 across indoor heat exchanger 40 to cool and dehumidify the indoor air. The flow of indoor air 114 continues into the plenum 16 formed at the indoor facing side of the bulkhead 46 and which is in fluid communication with indoor fan 42. After passing through the plenum 16, the recirculating flow of indoor air 114 passes through the discharge vent 112 and into the conditioned space.

At 206, the controller 64 determines psychrometric characteristics of the indoor air 114 after passing over or through the indoor heat exchanger 40 (i.e., downstream of the indoor heat exchanger 40). The controller 64 receives signals from, for example, the temperature sensor 120 and the humidity sensor 122 positioned downstream from the indoor heat exchanger 40. The signals received by the controller 64 correspond to the temperature and humidity, respectively, of the indoor air flow 114 after conditioning. The controller 64 determines, for example by executing a stored algorithm, the psychrometric characteristics of the conditioned indoor air 114 from the temperature and humidity signals received from 120, 122, respectively. The psychrometric characteristics of the indoor air 114 may alternately be determined by extracting data from a lookup table stored in a memory location of the controller 64 using the temperature and humidity information received from sensors 120, 122.

At 208, method 200 operates an auxiliary fan 102 at a first auxiliary fan speed to urge a flow of outdoor make-up air 116 to the plenum 16. According to some embodiments, auxiliary fan 102 may be a variable speed fan and may therefore provide various air flow rates of make-up air 116. The auxiliary fan urges the flow of outdoor make-up air 116 into plenum 16, separated from the indoor flow of air 114 by the bulkhead 46 and vent door 82.

At 210, the controller 64 determines psychrometric characteristics of the outdoor make-up air 116 prior to conditioning or mixing with the indoor air flow 114. The controller 64 receives signals from the temperature sensor 106 and the humidity sensor 108 positioned in the make-up air flow 116. The signals received by the controller 64 correspond to the temperature and humidity of the unconditioned outdoor make-up air flow 116. The controller 64 determines, for example by executing a stored algorithm as above, the psychrometric characteristics of the outdoor make-up air 116 from the temperature and humidity signals received from 106, 108, respectively. The psychrometric characteristics of the outdoor make-up air 116 may alternately be determined by extracting data from a lookup chart stored in a memory location of the controller 64 using the temperature and humidity information received from sensors 106, 108.

At 212, the controller determines, or predicts, from the signals received from the outdoor make-up air sensors 106, 108 and the indoor air sensors 120, 122, the possible range of psychrometric characteristics of a mixed air flow 118. The range of psychrometric characteristics is determined by the psychrometric characteristics of the indoor air and the outdoor make-up air; the actual psychrometric characteristics of the mixed air flow 118 is dependent on the mass flow rates of each the indoor air flow 114 and the outdoor make-up air flow 116. As is generally understood, when two air flows are thoroughly mixed, the resultant mixed air flow has uniform characteristics that represent a blending of characteristics of the two individual air flows. The psychrometric characteristics of the mixed air flow fall on a straight line on a psychrometric chart (e.g., FIG. 8) with endpoints representing the psychrometric characteristics of the two air flow to be combined. In particular, the characteristics of the resultant mixed air flow are proportional to the percentage of each of the individual air flows. In some cases, the characteristics of the mixed air flow approach, or may go beyond (i.e., above and to the left of), the saturation point, and water may condense out of the mixed air flow. The condensation may occur in various sections of the air conditioning unit 10 and may be difficult to control. The condensation may be deposited in unintended areas of the air conditioning unit 10, potentially leading to damaging rust and/or bacterial growth. In some cases, the condensation may form droplets carried by the flow of mixed air 118 and delivered to the conditioned space.

The characteristics of the individual air flows to be combined (i.e., the indoor air 114 and outdoor make-up air 116), and the predicted characteristics of the mixed air 118 may best be illustrated with reference to a representative psychrometric chart 128 (FIG. 8) plotting dry bulb temperature (DBT), wet bulb temperature (WBT), relative humidity (RH), and humidity ratio (HR) at a constant pressure. As illustrated in the psychrometric chart of FIG. 8, any two characteristics of an air flow determine the other characteristics. In the present embodiment, temperature and humidity, as determined by the controller 64 from signals received form the temperature and humidity sensors for outdoor make-up air (sensors 106, 108) and indoor conditioned air (sensors 120, 122), will be used to determine other psychrometric characteristics of interest.

In a representative example of mixing two air streams illustrated in FIG. 8, the flow of indoor air 114 has characteristics corresponding to 130 and the flow of outdoor make-up air 116 has characteristics corresponding to 132. In particular, the points 130 and 132 are determined by the temperature (DBT) and humidity (RH) sensed by the sensors 106, 108, 120, and 122. The characteristics of the mixed air flow 118 will lie along the mixed flow line 134, a straight line plotted between points representing the indoor air characteristics 130 and the outdoor make-up air characteristics 132. The position of the mixed flow characteristics along mixed flow line 134 is proportional to the mass percentage of the indoor and outdoor make-up air flows 114, 116. For example, if the mix of indoor air 114 and outdoor air 116 was equal in mass, the mixed flow would have characteristics corresponding to the mid-point of the mixed flow line 134. Similarly, if the indoor air 114 contributed 75% of the mass of the mixed air flow 118, the mixed flow characteristics would correspond to a point that is 25% along the mixed flow line 134 from the point representing the indoor air characteristics 130. Typically, the mixed airflow 118 is comprised of about 85% indoor air 114 and about 15% outdoor make-up air 116. Other mixed air compositions may be formed in accordance with embodiments of the present disclosure.

In some embodiments of the present disclosure, the indoor fan 42 and auxiliary fan 102 are variable speed fans. The fans 42, 102 may be calibrated to produce known mass flow rates for the indoor air 114 and the outdoor make-up air 116 based on the individual fan speed. By controlling the operating speed of the fans 42, 102, controller 64 may produce a known, or at least predicted, mass flow of indoor air 114 and outdoor make-up air 116. As discussed above, from the mass flow rates for each air flow 114, 116 with known psychrometric characteristics, the psychrometric characteristics for the mixed air flow 118 can be determined or predicted. Accordingly, step 212 can determine, or at least predict, that the characteristics of the mixed air flow 118 will lie along the mixed air flow line 134 proportionally closer to the end point of 134 corresponding to the air flow with the greater mass flow.

In other embodiments, the mass flow rate of the air flows 114, 116 may not be known. Instead, the endpoints 130, 132, corresponding to the indoor air flow 114 and outdoor make-up air 116, respectively, are known and the mixed air flow line 134 can be mathematically determined as the straight line joining the endpoints 130, 132. Accordingly in these other embodiments, step 212 can determine, or at least predict, that the characteristics of the mixed air flow 118 will lie along the mixed air flow line 134.

FIG. 8 graphically illustrates a mixed flow line 134, as determined at step 212, superimposed on psychrometric chart 128. In embodiments, mathematical representations of the psychrometric chart 128, the endpoints 130, 132, and the mixed air flow line 134 are used in place of the graphical representation illustrated. Step 214 determines that at least a portion of the mixed flow line 134 exceeds a predetermined limit. As used herein, the predetermined limit is a set of points representing relative humidity values and illustrated in FIG. 8 as a line curved upward and to the right. For example, as illustrated in FIG. 8, a portion 136 of mixed flow line 134 proximate to 132 is coincident with, or lies above and to the left of, the line representing 100% RH, saturated line SL, which may be the predetermined limit. Accordingly, as illustrated, at least a portion of the mixed flow line 134 exceeds a predetermined limit.

In other embodiments, the predetermined limit may be offset from the SL, downward and to the right, representing a lower RH. For example, the predetermined limit may be the line 137 representing a 95% RH psychrometric condition. In an alternate embodiment, the predetermined limit may be an RH curve representing an offset from the SL by a set DB temperature. For example, in this embodiment the predetermined limit may be a curved line 138 formed by a set of points representing a 5 degree dry bulb offset from the SL. This moves the predetermined curve 5 degrees to the right (i.e., in the X direction) as illustrated by arrow 140. In yet another embodiment, the predetermined limit may be an offset from the SL by a set DPT. For example, in this embodiment, the predetermined limit is a curved line 142 formed by a set of points representing a 5 degree dew point temperature offset. In other words, the DPT typically associated with a particular temperature is reduced by 5 degrees as illustrated in FIG. 10 by arrow 144. The effect is a curve offset vertically (i.e., in the Y direction) below the typical SL. Other embodiments may establish still other predetermined limits offset below and to the right of the SL curve.

Step 214 determines if the range of possible psychrometric characteristics of the mixed flow of air 118 exceeds the predetermined limit established as above. For example, in an embodiment, step 214 executes a stored (e.g., at the controller) algorithm processing the known psychrometric characteristics of the indoor air 114 and the outdoor make-up air 116 forming a mathematical representation of the range of possible psychrometric characteristics of the mixed air flow 118 (i.e., a mathematical representation of the mixed air flow line 134). The algorithm compares the mathematical representation of the mixed air flow 118 to a mathematical model of an appropriate psychrometric chart modified to include the predetermined limit. The algorithm determines that a portion of the mathematical representation of the range of possible psychrometric characteristics of the mixed air flow exceeds a predetermined limit.

In an exemplary embodiment, a mathematical model of a default psychrometric chart, for a particular atmospheric pressure and with the predetermined limit, is stored in a memory location. In an alternate embodiment, the algorithm senses an atmospheric pressure and selects or creates a mathematical model representing a chart for that atmospheric pressure. The mathematical model is modified to include the predetermined limit as above. In another embodiment, the unit 10 may request input, upon installation of the unit 10 or at a later time, corresponding to the atmospheric pressure corresponding to the installation location. From the input data, the algorithm selects or creates an appropriate psychrometric chart with the predetermined limit. The algorithm compares the mathematical representation of the range of possible psychrometric characteristics of the mixed air flow to the stored or created mathematical model of the default psychrometric chart.

The range of possible psychrometric characteristics of the mixed flow 118 are determined in an alternate embodiment by extracting data from one or more lookup tables stored in a memory location for one or more atmospheric pressure conditions. The appropriate lookup table is selected based on a default atmospheric pressure, a measured atmospheric pressure, or a user-input pressure. Data for the range of characteristics is extracted from the lookup table based on the signals received from the outdoor make-up air sensors 106, 108 and the indoor air sensors 120, 122 processed as above. The extracted data is used to form a mathematical representation of the possible psychrometric characteristics of the mixed flow 118. The mathematical representation is compared to a mathematical model of an appropriate psychrometric chart stored or created as above, and modified to include the predetermined limit.

When the psychrometric characteristics of the mixed air flow 118 exceeds the predetermined limit as determined in 214, method 200 advances to 216. At step 216, the controller 64 implements a responsive action to modify the calculated or predicted characteristics of the mixed air flow 118. The responsive action is directed to moving the predicted characteristics of the mixed air flow 118 away from the predetermined limit (i.e., down along the mixed air flow line 134 or down and to the right in FIG. 8). To achieve this, the responsive action according to the present method modifies the operating parameters of the indoor fan 42 or the refrigeration loop 48, or both the indoor fan 42 and the refrigeration loop 48.

In an embodiment, the responsive action at step 216 comprises operating the indoor fan 42 at a second speed (i.e., decreasing or increasing the speed of indoor fan 42) to modify the amount of indoor air 114 drawn into the air conditioner unit 10 and through the indoor heat exchanger 40 to mix with outdoor make-up air 116. For example, as discussed above, increasing the percentage of indoor air 114 in the mixed airflow 118 moves the point representing the mixed airflow characteristics down the mixed air flow line 134 and closer to the indoor characteristics 130, therefore away from the predetermined limit. Operating indoor fan 42 at a second speed (i.e., decreased or increased fan speed) while leaving the speed of auxiliary fan 102 unchanged, modifies the mass flow rate of the indoor air 114 into the plenum 16 to form the mixed air flow 118 (with the outdoor make-up air flow 116). Thus, the percentage of indoor air in the mixed air flow increases with increased fan speed and decreases with decreased fan speed. The speed of indoor fan 42 may be ramped up (or down) to the second fan speed in steps, for example in steps of 25 RPM per minute, until a maximum (or minimum) fan speed is reached.

Similarly, in an embodiment in which the auxiliary fan 102 is a variable speed fan, the speed of the auxiliary fan 102 is modified to decrease or increase the mass flow rate (i.e., flow rate) of outdoor make-up air 116 into the mixed air flow 118, reducing or increasing, respectively, the amount of humidity introduced to the mixed flow 118. For example, by reducing the mass flow rate of outdoor make-up air 116 in the mixed air flow 118, the characteristics of the mixed air flow 118 will move along line 134 towards endpoint 130 as the mass percentage of indoor air 114 increases in the mixed air flow 118. In some embodiments, the mass flow rate of the outdoor make-up air 116 may be reduced to zero, or substantially zero, for example by reducing the speed of the auxiliary fan 102 to zero or closing the vent door 82, or both reducing the speed of the auxiliary fan 102 and closing the vent door 82. In embodiments, the outdoor make-up air flow is reduced to zero or substantially zero temporarily or intermittently.

Continuing with the example above, alternately or in addition to increasing the speed of indoor fan 42, the responsive action of step 216 comprises adjusting the operating parameters of the refrigeration loop 48, to move the psychrometric characteristics of the conditioned indoor air 130 down and to the right in FIG. 8. This moves the lower endpoint (i.e., the point corresponding to indoor air characteristics 130) of the mixed flow line 134 away from the predetermined limit, which in this exemplary case is the SL.

In an embodiment, adjusting the operating parameters of the refrigeration loop 48 includes modifying the superheat target at the indoor heat exchanger (i.e., evaporator) 40 by adjusting the settings of the EEV 50. For example, the controller 64 modifies the superheat at the indoor heat exchanger 40 from the default 2° F. temperature differential to a larger differential, for example 6° F. Modifying the superheat may change the sensible heat ratio at the indoor heat exchanger 40 to move the characteristics of the indoor air away from the SL. The sensible heat ratio is understood to be the ratio of sensible heat transfer to the total heat transfer. In the present example, heat is transferred from the indoor air to the refrigerant, thereby dehumidifying and cooling the indoor air 114. This is represented graphically in FIG. 8 as the point representing the psychrometric characteristics of the indoor air 114 moves from 130 to 131. The effect of changing the superheat is that the endpoint representing the indoor air of the mixed air flow line moves from 130 to 131, modifying the mixed air flow line from 134 to 135. As illustrated, the mixed air flow line 135 has moved away from the predetermined limit, which in this example is the SL. As further illustrated, all, or substantially all, of the mixed flow line 135 lies below the predetermined limit. Accordingly, all, or substantially all, of the mass flow combinations of the indoor air 114 and the outdoor make-up air 116 are below the predetermined limit.

In an embodiment, the compressor 34 is a variable speed compressor operatively linked to the controller 64 such that the controller 64 may adjust the operating speed of the compressor 34. In this regard, in an embodiment, the responsive action of step 216 comprises adjusting the operating parameters of the refrigeration loop 48 by modifying the operating speed of the compressor from a first speed to a second speed to increase the slope of the mixed air flow line, e.g., from 134 to 135. The controller 64 may decrease or increase the compressor speed depending on the indoor and outdoor air characteristic 130, 132. For example, the responsive action of step 216 may be for the controller 64 to signal the compressor 34 to operate at a slower speed. This may be accomplished by ramping down the compressor speed in steps of 100 RPM per minute until a minimum speed is reached. The effect of decreasing compressor speed may be a higher temperature (moving 130 to the right) and a higher humidity ratio (moving 130 upwards). Under certain indoor and outdoor air conditions, decreasing the compressor speed may move the mixed air flow line 134 away from the predetermined limit.

Accordingly, by modifying the psychrometric characteristics of the indoor air 114 before mixing with the outdoor make-up air 116, the psychrometric characteristics of a mixed air flow 118 (comprising conditioned indoor air 114 and unconditioned outdoor make-up air can be maintained in a range that will prevent unintended condensation forming in the air passages.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An air conditioner unit comprising:

a refrigeration loop comprising an indoor heat exchanger and an outdoor heat exchanger;

a compressor operably coupled to the refrigeration loop and being configured to urge refrigerant through the refrigeration loop;

an expansion device fluidly coupled to the refrigeration loop;

an indoor fan operable to urge an indoor air flow through the indoor heat exchanger;

an auxiliary fan operable to urge an outdoor make-up air flow to combine with the indoor air flow to produce a mixed air flow; and a controller operably coupled to the compressor, the expansion device, the indoor fan, the auxiliary fan, the controller being configured to:

operate the refrigeration loop at default parameters;

operate the indoor fan at a first indoor fan speed;

determine characteristics of the indoor air flow;

operate the auxiliary fan at a first auxiliary fan speed;

determine characteristics of an outdoor make-up air flow;

predict characteristics of the mixed air flow from the determined characteristics of the indoor air flow and the determined characteristics of the outdoor make-up air flow;

determine that the predicted characteristics of the mixed air flow are greater than a predetermined limit; and implement a responsive action in response to determining that the predicted characteristics of the mixed air flow exceed the predetermined limit.

2. The air conditioner unit of claim 1, further comprising an indoor air temperature sensor and an indoor humidity sensor, the indoor air temperature sensor and the indoor humidity sensor in operable communication with the controller, wherein:

the indoor air temperature sensor communicates to the controller an indoor air temperature signal corresponding to a temperature of the indoor air flow;

the indoor humidity sensor communicates to the controller an indoor humidity signal corresponding to a humidity of the indoor air flow; and the controller determines the characteristics of the indoor air flow from the indoor air temperature signal and the indoor humidity signal.

3. The air conditioner unit of claim 2, wherein the indoor air temperature sensor and the indoor humidity sensor are located downstream from the indoor heat exchanger.

4. The air conditioner unit of claim 1, further comprising an outdoor make-up air temperature sensor and an outdoor make-up air humidity sensor, the outdoor make-up air temperature sensor and the outdoor make-up air humidity sensor in operable communication with the controller, wherein;

the outdoor make-up air temperature sensor communicates a temperature signal corresponding to a humidity of the outdoor make-up air flow to the controller; and the outdoor make-up air humidity sensor communicates a humidity signal corresponding to a humidity of the outdoor make-up air to the controller.

5. The air conditioner unit of claim 1, wherein implementing the responsive action comprises increasing a flow rate of indoor air through the indoor heat exchanger.

6. The air conditioner unit of claim 5, wherein the indoor fan is a variable speed fan and implementing the responsive action comprises:

increasing the flow rate of the indoor air by operating the indoor fan at a second indoor fan speed.

7. The air conditioner unit of claim 1, wherein implementing the responsive action comprises modifying a superheat at the indoor heat exchanger.

8. The air conditioner unit of claim 7, wherein:

the expansion device is an electronic expansion valve in operative communication with the controller; and modifying the superheat comprises adjusting the electronic expansion valve from a first valve position to a second valve position, wherein the second valve position corresponds to a higher operating superheat than a superheat corresponding to the first valve position.

9. The air conditioner unit of claim 1, wherein:

the compressor is a variable speed compressor; and implementing the responsive action comprises modifying a compressor speed from a first compressor speed to a second compressor speed.

10. A method of operating an air conditioner unit comprising a refrigeration loop comprising an indoor heat exchanger, an outdoor heat exchanger, a compressor configured to urge refrigerant through the refrigeration loop, an expansion device, an indoor fan operable to urge an indoor air flow over the indoor heat exchanger, and an auxiliary fan operable to urge a flow of outdoor air to combine with the flow of indoor air to produce a mixed air flow, the method comprising:

operating the refrigeration loop at default parameters;

operating the indoor fan at a first indoor fan speed;

determining characteristics of the indoor air flow;

operating the auxiliary fan at a first auxiliary fan speed;

determining characteristics of an outdoor make-up air flow;

predicting characteristics of the mixed air flow from the determined characteristics of the indoor air flow and the determined characteristics of the outdoor make-up air flow;

determining that the predicted characteristics of the mixed air flow are greater than a predetermined limit; and implementing a responsive action in response to determining that the predicted characteristics of the mixed air flow exceed the predetermined limit.

11. The method of claim 10, wherein predicting the characteristics of the mixed air flow comprises:

receiving an indoor air temperature signal and an indoor air humidity signal corresponding to a temperature and a humidity of the indoor air flow downstream of the indoor heat exchanger;

determining characteristics of the indoor air from the indoor air temperature signal and the indoor air humidity signal;

receiving an outdoor make-up air temperature signal and an outdoor make-up air humidity signal corresponding to a temperature and a humidity of the outdoor make-up air flow;

determining characteristics of the outdoor make-up air from the outdoor make-up air temperature signal and an outdoor make-up air humidity signal; and predicting a range of characteristics of the mixed air flow from the determined characteristics of the indoor air and the determined characteristics of the outdoor make-up air.

12. The method of claim 11, wherein predicting the range of characteristics of the mixed air flow comprises:

executing an algorithm processing the determined characteristics of the indoor air and the determined characteristics of the outdoor make-up air; and forming a mathematical representation of the range of possible psychrometric characteristics of the mixed air flow.

13. The method of claim 12, wherein determining that the predicted characteristics of the mixed air flow are greater than a predetermined limit comprises:

comparing the mathematical representation of the mixed air flow to a mathematical model of a psychrometric chart; and determining that a portion of the mathematical representation of the range of possible psychrometric characteristics of the mixed air flow exceeds a predetermined limit.

14. The method of claim 11, wherein predicting the range of characteristics of the mixed air flow comprises:

receiving the determined characteristics of the indoor air and the determined characteristics of the outdoor make-up air; and extracting data from one or more lookup tables stored in a memory location based on the determined characteristics of the indoor air and the determined characteristics of the outdoor make-up air.

15. The method of claim 10, wherein implementing a responsive action comprises modifying a flow rate of indoor air through the indoor heat exchanger.

16. The method of claim 15, wherein:

the indoor fan is a variable speed fan; and implementing the responsive action comprises increasing the flow rate of the indoor air by operating the indoor fan at a second indoor fan speed.

17. The method of claim 15, wherein:

the auxiliary fan is a variable speed fan; and implementing the responsive action comprises decreasing the flow rate of the outdoor make-up air by operating the auxiliary fan at a second auxiliary fan speed.

18. The method of claim 10, wherein implementing a responsive action comprises modifying a superheat at the indoor heat exchanger.

19. The method of claim 18, wherein the expansion device is an electronic expansion valve, the method further comprising:

modifying the superheat comprises adjusting the electronic expansion valve from a first valve position to a second valve position, wherein the second valve position corresponds to a higher operating superheat than a superheat corresponding to the first valve position.

20. The method of claim 10, wherein:

the compressor is a variable speed compressor; and implementing the responsive action comprises modifying a compressor speed from a first compressor speed to a second compressor speed.

* * * * *